US009410720B2

(12) United States Patent
Jurczyszak et al.

(10) Patent No.: US 9,410,720 B2
(45) **Date of Patent: *Aug. 9, 2016**

(54) FLUID HEATING SYSTEM AND INSTANT FLUID HEATING DEVICE

(71) Applicant: EEMAX, INC., Waterbury, CT (US)

(72) Inventors: Eric R. Jurczyszak, Berlin, CT (US); Jeff Hankins, Southbury, CT (US); Chris Hayden, Shelton, CT (US); Emily Morris, Torrington, CT (US); Roland Opena, Cromwell, CT (US); Nicholas Visinski, Fairfield, CT (US)

(73) Assignee: EEMAX, INC., Waterbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/824,897

(22) Filed: Aug. 12, 2015

(65) Prior Publication Data

US 2015/0345830 A1 Dec. 3, 2015

Related U.S. Application Data

(63) Continuation of application No. 13/840,066, filed on Mar. 15, 2013, now Pat. No. 9,140,466.

(60) Provisional application No. 61/672,336, filed on Jul. 17, 2012.

(51) Int. Cl.
*F24H 1/10* (2006.01)
*F24H 9/20* (2006.01)
(Continued)

(52) U.S. Cl.
CPC ..... *F24H 9/2028* (2013.01); *F24H 1/101* (2013.01); *F24H 1/105* (2013.01); *H05B 1/0283* (2013.01); *F24D 17/0089* (2013.01)

(58) Field of Classification Search
None
See application file for complete search history.

(56) References Cited

U.S. PATENT DOCUMENTS 1,718,970 A 7/1929 Lonergan
1,851,851 A 3/1932 Lee et al.
(Continued)

FOREIGN PATENT DOCUMENTS

CN 201844531 5/2011
DE 197 26 288 A1 6/1997
(Continued)

OTHER PUBLICATIONS

International Search Report issued Jun. 5, 2013 7in PCT/US13/32298 filed Mar. 15, 2013.
(Continued)

*Primary Examiner* — Thor Campbell
(74) *Attorney, Agent, or Firm* — Oblon, McClelland, Maier & Neustadt, L.L.P

(57) ABSTRACT

A fluid heating system may be installed for residential and commercial use, and may deliver fluid at consistent high temperatures for cooking, sterilizing tools or utensils, hot beverages and the like, without a limit on the number of consecutive discharges of fluid. The fluid heating system is installed with a tankless fluid heating that includes an inlet port, an outlet port, a drain port, at least one heat source connected with the inlet port, and a valve manifold connected to the at least one heat source, the drain port, and the outlet port. A temperature sensor is downstream of the at least one heat source and connected to the valve manifold. The valve manifold is operated so that an entire volume of a fluid discharge from the fluid heating system is delivered at a user-specified temperature (including near boiling fluid) on demand, for every demand occurring over a short period of time.

15 Claims, 8 Drawing Sheets

(51) Int. Cl.

| | |
|---|---|
| ***H05B 1/02*** | (2006.01) |
| *F24D 17/00* | (2006.01) |

(56) References Cited

U.S. PATENT DOCUMENTS

| | | | |
|---|---|---|---|
| 2,681,409 | A | 6/1954 | Dobbins |
| 3,633,748 | A | 1/1972 | Hanley |
| 4,056,143 | A | 11/1977 | Martin |
| 4,338,888 | A | 7/1982 | Gerstmann et al. |
| 5,054,108 | A | 10/1991 | Gustin et al. |
| 5,216,743 | A | 6/1993 | Seitz |
| 5,243,185 | A | 9/1993 | Blackwood |
| 5,293,446 | A | 3/1994 | Owens et al. |
| 5,325,822 | A | 7/1994 | Fernandez |
| 5,384,032 | A | 1/1995 | De Souza |
| 5,408,578 | A | 4/1995 | Bolivar |
| 5,628,895 | A | 5/1997 | Zucholl |
| 5,740,315 | A | 4/1998 | Onishi et al. |
| 5,930,458 | A | 7/1999 | Yane et al. |
| 6,097,007 | A | 8/2000 | Wang |
| 6,199,515 | B1 | 3/2001 | Clarke |
| 6,231,194 | B1 | 5/2001 | Raj et al. |
| 6,240,250 | B1 | 5/2001 | Blanco, Jr. |
| 6,246,831 | B1 | 6/2001 | Seitz et al. |
| 6,252,220 | B1 | 6/2001 | Jedlicka et al. |
| 6,297,740 | B1 | 10/2001 | Hill et al. |
| 6,593,553 | B2 | 7/2003 | Whitfield |
| 7,007,316 | B2 | 3/2006 | Lutz |
| 7,039,305 | B1 | 5/2006 | Chen |
| 7,046,922 | B1 | 5/2006 | Sturm et al. |
| 7,156,425 | B2 | 1/2007 | Atkinson |
| 7,190,894 | B2 | 3/2007 | Chamberlain, Jr. |
| 7,293,914 | B2 | 11/2007 | Wang |
| 7,324,746 | B2 | 1/2008 | Tanaka et al. |
| 7,592,572 | B2 | 9/2009 | Schlipf |
| 7,668,444 | B2 | 2/2010 | Tsai |
| 7,857,002 | B2 | 12/2010 | Reck |
| 8,104,434 | B2 | 1/2012 | Fabrizio |
| 8,165,461 | B2 | 4/2012 | Sullivan |
| 8,280,236 | B2 | 10/2012 | Fabrizio |
| 8,577,211 | B2 | 11/2013 | Lucker et al. |
| 2002/0008970 | A1 | 1/2002 | Hanson et al. |
| 2003/0026603 | A1 | 2/2003 | Castaneda et al. |
| 2006/0215178 | A1 | 9/2006 | Seko et al. |
| 2006/0222349 | A1 | 10/2006 | Sturm et al. |
| 2008/0028512 | A1 | 2/2008 | Hughson |
| 2008/0152331 | A1 | 6/2008 | Ryks |
| 2009/0034947 | A1 | 2/2009 | Tsai |
| 2010/0086289 | A1 | 4/2010 | Johnson et al. |
| 2010/0212752 | A1 | 8/2010 | Fima |
| 2011/0203781 | A1 | 8/2011 | Ellingwood et al. |
| 2011/0233191 | A1 | 9/2011 | Gubler et al. |
| 2011/0240269 | A1 | 10/2011 | Mackenzie |
| 2012/0055917 | A1 | 3/2012 | Kimmins et al. |
| 2012/0275775 | A1 | 11/2012 | Iskrenovic |
| 2013/0034344 | A1 | 2/2013 | Lutz et al. |
| 2014/0023354 | A1 | 1/2014 | Hankins et al. |

FOREIGN PATENT DOCUMENTS

| | | |
|---|---|---|
| JP | 11-148716 | 6/1999 |
| WO | WO 98/31045 A2 | 7/1998 |

OTHER PUBLICATIONS

International Written Opinion issued Jun. 5, 2013 in PCT/US13/32298 filed Mar. 15, 2013.

International Search Report issued Jan. 3, 2014, in PCT/US/2013/050897, filed Jul. 17, 2013.

Written Opinion of the International Searching Authority dated Jan. 3, 2014, in PCT/US2013/050897, filed Jul. 17, 2013.

Office Action mailed Apr. 24, 2015 in co-pending U.S. Appl. No. 13/943,495.

Combined Chinese Office Action and Search Report issued Sep. 25, 2015 in Patent Application No. 201380046720.5 (with English language translation).

FLUID HEATING SYSTEM AND INSTANT FLUID HEATING DEVICE

CROSS REFERENCE TO RELATED APPLICATIONS

This application is a continuation application of U.S. application Ser. No. 13/840,066 filed Mar. 15, 2013, which is based upon and claims the benefit of priority from the U.S. Provisional Application No. 61/672,336, filed on Jul. 17, 2012, the entire contents of both are incorporated herein by reference.

BACKGROUND OF THE INVENTION

Conventional fluid heating devices slowly heat fluid enclosed in a tank and store a finite amount of heated fluid. Once the stored fluid is used, conventional fluid heating devices require time to heat more fluid before being able to dispense fluid at a desired temperature. Heated fluid stored within the tank may be subject to standby losses of heat as a result of not being dispensed immediately after being heated. While fluid is dispensed from a storage tank, cold fluid enters the tank and is heated. However, when conventional fluid heating devices are used consecutively, the temperature of the fluid per discharge is often inconsistent and the discharged fluid is not fully heated.

Users desiring fluid at specific temperature often employ testing the fluid temperature by touch until a desired temperature is reached. This can be dangerous, as it increases the risk that a user may be burned by the fluid being dispensed, and can cause the user to suffer a significant injury. There is also risk of injury involved in instances even where the user does not self-monitor the temperature by touch, since many applications include sinks and backsplash of near boiling fluid may occur.

Other conventional fluid heating devices heat water instantly to a desired temperature. However, as fluid is dispensed immediately, some fluid dispensed is at the desired temperature and some fluid is not. Thus the entire volume of fluid dispensed may not be at the same desired temperature.

SUMMARY OF THE INVENTION

In selected embodiments of the invention, a fluid heating system includes a fluid heating device. The fluid heating system may be installed for residential and commercial use, and may provide fluid at consistent high temperatures for cooking, sterilizing tools or utensils, hot beverages and the like, without a limit on the number of consecutive discharges of fluid. Embodiments of the tankless fluid heating device described herein, may deliver a limitless supply of fluid at a user-specified temperature (including near boiling fluid) on demand, for each demand occurring over a short period of time. Further, embodiments of the fluid heating devices described herein provide that an entire volume of fluid is at the same user-defined temperature each time fluid is discharged.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings. The accompanying drawings have not necessarily been drawn to scale. In the accompanying drawings.

DETAILED DESCRIPTION OF ILLUSTRATIVE EMBODIMENTS

Figure 1:
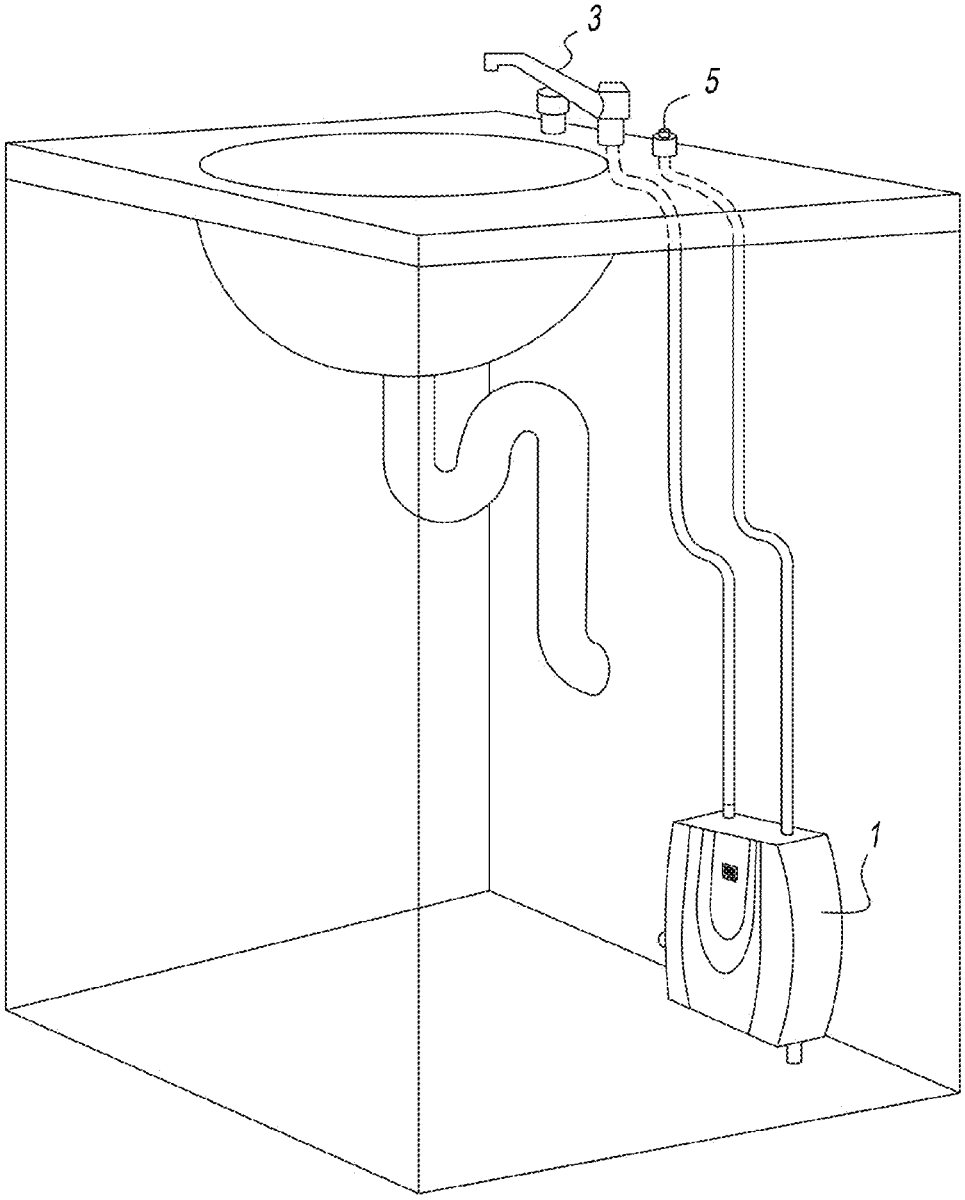
FIG. 1 illustrates an exemplary fluid heating system.

The following description relates to a fluid heating system, and specifically a fluid heating device that repeatedly delivers fluid at the same high temperature, on demand without a large time delay. In selected embodiments, the fluid heating device does not include a tank for retaining fluid, and thus provides a more compact design which is less cumbersome to install than other fluid heating devices. The fluid heating device includes at least one heat source connected to an inlet port and a manifold. The manifold is connected to a valve manifold by an intermediate conduit, and the valve manifold is connected to an outlet port by an outlet conduit. A flow regulator and first temperature sensor are incorporated into the intermediate conduit. A flow sensor monitors a flow rate of fluid into the at least one heat source. A controller communicates with the at least one heat source, flow sensor, first temperature sensor, valve manifold, and an activation device. In selected embodiments, the fluid heating device may supply fluid at a desired high temperature (e.g. 200° F.) consistently even when the activation switch is operated repeatedly over a short period of time.

Referring now to the drawings, wherein like reference numerals designate identical or corresponding parts throughout the several views. It is noted that as used in the specification and the appending claims the singular forms "a," "an," and "the" can include plural references unless the context clearly dictates otherwise.

FIG. 1 illustrates a fluid heating system according to one example which is incorporated in a commercial or residential application. A fluid heating device 1 is installed under a sink and connected to a fluid supply and a fluid discharge device 3. An activation switch 5 is provided with the fluid discharge device 3 and electrically connected to a fluid heating device 1. The fluid heating device 1 is an instant heating device and may provide fluid at a consistent high temperature for cooking, sterilizing tools or utensils, hot beverages and the like, without a limit on the number of consecutive discharges of fluid.

Figure 2:
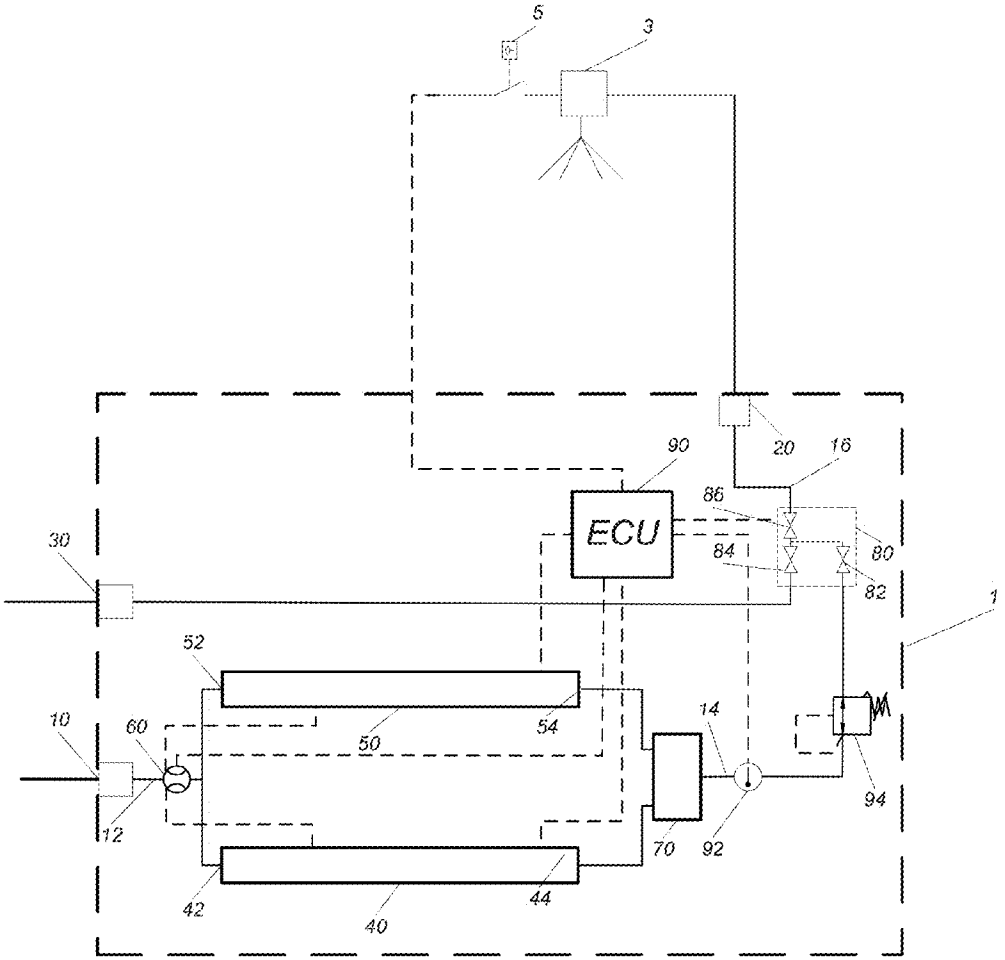
FIG. 2 schematically illustrates a fluid heating system according to one example.

FIG. 2 schematically illustrates a fluid heating system according to one example. The fluid heating system of FIG. 2 includes the fluid heating device 1, the fluid discharge 3 which could be a faucet, spigot, or other fluid dispenser, and the activation switch 5. The activation switch 5 may include a push-button, touch sensitive surface, infrared sensor, or the like. The fluid heating device 1 includes an inlet port 10, an outlet port 20, and a drain port 30. The inlet port 10 is connected to a flow sensor 60 by an inlet conduit 12. The flow sensor 60 is connected to a first heat source 40 and a second heat source 50, by a first heat source inlet 42 and second heat source inlet 52 respectively. A manifold may also be provided to connect a line extending from the flow sensor 60 to each heat source inlet. Although two heat sources are illustrated in FIG. 2, a single heat source or more than two heat sources may be provided. A manifold 70 is connected to a first heat source outlet 44 and a second heat source outlet 54, and an intermediate fluid conduit 14. A first temperature sensor 92 is installed in the intermediate fluid conduit 14. The intermediate fluid conduit 14 is connected to a regulator 94 which is connected to a valve manifold 80. The valve manifold 80 is connected by an outlet conduit 16 to the outlet port 20. The outlet port 20 is connected to the fluid discharge 3 by a conduit (not shown).

During operation, when the activation switch 5 is operated, the fluid heating device 1 can operate the first heat source 40 and the second heat source 50 to supply fluid from a fluid supply (not shown) connected to the inlet port 10, at a high temperature (e.g. 200° F. or any other temperature corresponding to just below a boiling point of a type of fluid), without a large time delay. The fluid heating system of FIG. 2 is able to heat fluid rapidly upon operation of the activation switch 5, without the need of a tank to hold the fluid supply. The fluid heating device 1 is advantageously compact and may be installed readily in existing systems, including for example a fluid dispenser for a sink within a residence, business, or kitchen. As the fluid heating device 1 does not require a fluid tank, less space is required for installation.

Figure 3:
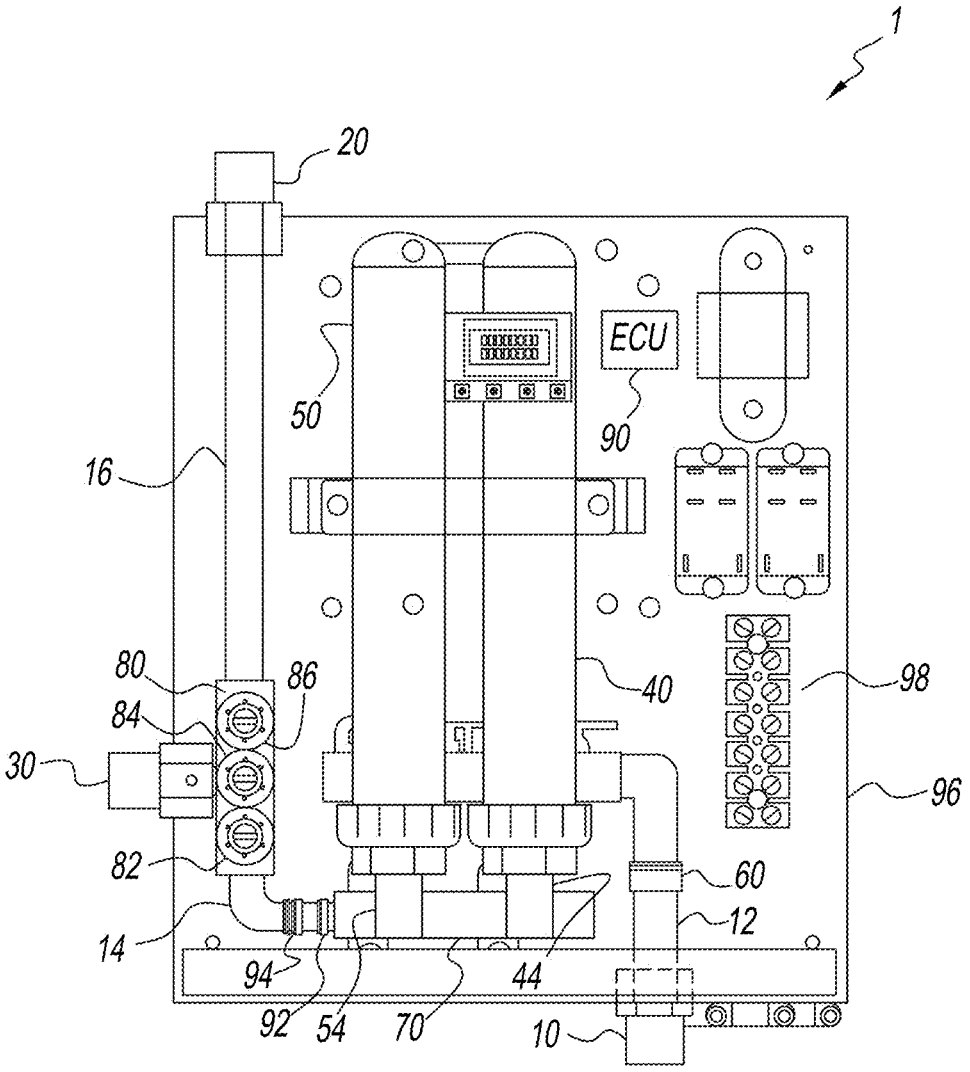
FIG. 3 illustrates a fluid heating device according to one example.

FIG. 3 illustrates the fluid heating device 1 according to the present disclosure partially enclosed in a housing 96. In FIG. 3 a front cover of the housing 96 removed. The inlet port 10 is connected to the first heat source 42 and the second heat source 50 by the inlet conduit 12. A flow rate of fluid, flowing from the inlet conduit 12 into the first heat source 40 and the second heat source 50, is detected by the flow sensor 60. The flow sensor 60 includes a flow switch (not shown) that sends a signal to the first heat source 40 and the second heat source 50 when a minimum flow rate (e.g. 0.5 gm) is detected. The flow sensor 60 may include a magnetic switch, and be installed within the inlet conduit 12. Once activated by the flow switch in the flow sensor 60, the controller 90 regulates a power supply to the first heat source 40 and the second heat source 50 (e.g. the controller 90 may regulate the current supplied to the heat sources by Pulse Width Modulation (PWM)). In selected embodiments, the flow sensor 60 may send a signal to a controller 90, and in addition to regulating a present power supply, the controller 90 may be configured to turn the first heat source 40 and the second heat source 50 on and off by providing or discontinuing the power supply.

The fluid manifold 70 is connected to the valve manifold 80 by the intermediate fluid conduit 14. The first temperature sensor 92 and the flow regulator 94 are provided within the intermediate fluid conduit 14. The first temperature sensor 92 sends a signal to the controller 90 indicating the temperature of the fluid flowing immediately from the first heat source 40 and the second heat source 50. The flow regulator 94 may include a manually operated ball valve or a self-adjusting in-line flow regulator. In the case of the ball valve, the ball valve can be manually set to a pressure that corresponds to a given flow rate. In the case of the in-line flow regular, the in-line flow regulator adjusts depending on the flow rate of the fluid in the intermediate conduit 14, and may contain an o-ring that directly restricts flow.

The flow regulator 94 may regulate the flow rate of fluid flowing from the first heat source 40 and the second heat source 50 at a predetermined flow rate. The predetermined flow rate may correspond to the minimum flow rate at which the flow switch in the flow sensor 60 will send a signal to activate the first heat source 40 and the second heat source 50 (once the flow sensor 60 detects a flow rate equal to or greater than the minimum flow rate). An advantage of installing the flow regulator 94 in the intermediate conduit 14 is that a pressure drop in the first heat source 40 and the second heat source 50 may be avoided. Maintaining a high pressure in the heat sources reduces the chance for fluid to be vaporized, which may create pockets of steam in the heat sources during operation and cause respective heating elements in the heating sources to fail.

Fluid is conveyed from the fluid manifold 70 to the valve manifold 80 through the intermediate conduit 14, and may be directed to either the outlet port 20 or the drain port 30 by the valve manifold 80. The valve manifold 80 is connected to the outlet port 20 by a fluid outlet conduit 16. The drain port 30 may extend directly from, or be connected through an additional conduit, to the valve manifold 80. Fluid flowing in the intermediate conduit 14, or the outlet conduit 16, can be discharged from the fluid heating device 1 by the valve manifold 80.

As illustrated in FIG. 3, the fluid heating device 1 includes a housing 96. The housing 96 includes an inner wall 98. The first heat source 40, second heat source 50, valve manifold 80, and the controller 90 are mounted onto the inner wall 98 of the housing 96. The compact arrangement of the first heat source 40 and the second heat source 50 within the housing 98, permits installation in existing systems. Further, as a result of the operation of the valve manifold 80, the fluid heating device 1 does not convey fluid below a predetermined temperature to the discharge device 3.

Figure 4:
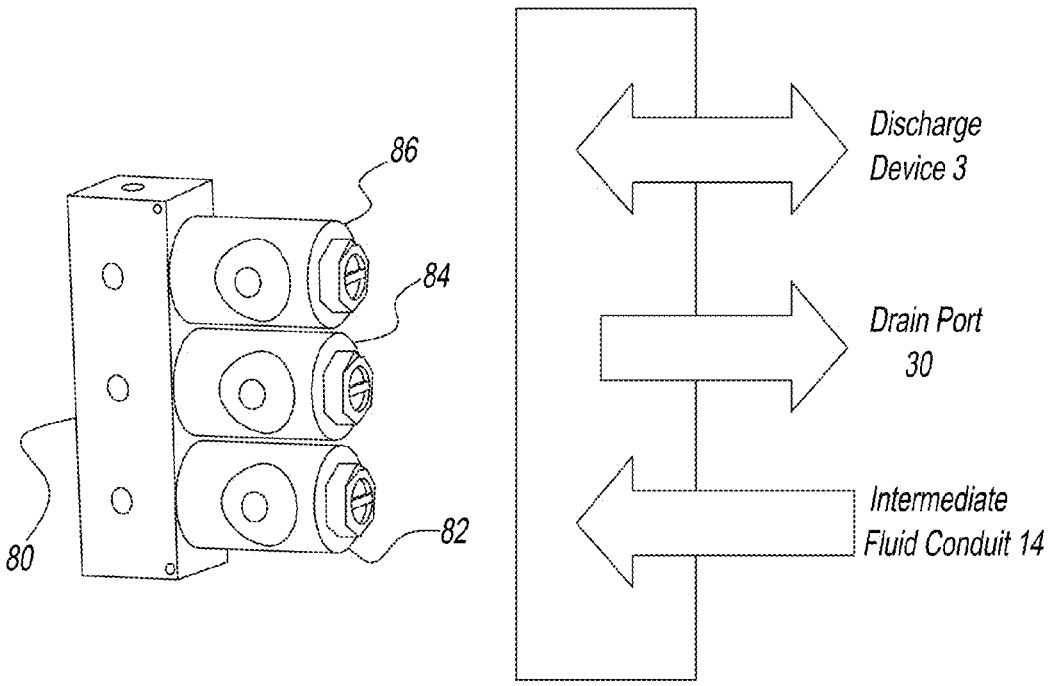
FIG. 4 illustrates a valve manifold according to one example.

FIG. 4 illustrates a valve manifold according to the selected embodiment. The valve manifold 80 includes a first valve 82, a second valve 84, and a third valve 86 which are operated by the controller 90. The first valve 82 is connected to the fluid conduit 14, the second valve 84 is connected to the drain port 30, and the third valve 86 is connected to the outlet conduit 16. Each of the first valve 82, second valves 84, and third valve 86 may be a solenoid valve. Further, two-way or three-way solenoid valves may be provided for each valve in the valve manifold 80. Fluid in the intermediate conduit 14 or the outlet conduit 16, may be directed to the outlet port 20 or the drain port 30 by the operation of the first valve 82, second valve 84, and third valve 86 of the valve manifold 80.

As illustrated in FIG. 2, the controller 90 communicates with the activation switch 5, the first heat source 40, the second heat source 50, flow sensor 60, the valve manifold 80, and the first temperature sensor 92. As described above, the first valve 82, second valve 84, and the third valve 86 each may be a solenoid valve operated by a signal from the controller 90. During operation, when an activation switch 5 is operated, a signal is sent to the controller 90 to provide high temperature fluid. The controller 90 operates the valve manifold 80 to discharge fluid in the outlet conduit 16 to the drain port 30 and takes a reading from the flow sensor 60. Upon a determination that the flow rate is equal to or above the predetermined flow rate, the flow switch provided in the flow sensor 60 activates the first heat source 40 and the second heat source 50. The controller 90 receives the signal from the flow sensor 60, and controls the power supply to the first heat source 40 and the second heat source 50, and operates the valve manifold 80 in accordance with the temperature detected by the first temperature sensor 92.

When the flow sensor 60 detects the flow rate is above the predetermined flow rate (e.g. 0.5 gpm), and a temperature detected by the first sensor 92 is below a predetermined temperature, the control 90 operates the valve manifold 80 to discharge fluid from the fluid conduit 14 through the drain port 30. In order for fluid to reach the predetermined temperature, the controller 90 may use the reading from the first temperature sensor 92 to determine the amount of power to be supplied to the first heat source 40 and the second heat source 50. The controller 90 opens the first valve 82 and the second valve 84, and closes the third valve 86 to discharge fluid from the fluid heating device 1 to the drain port 30. When the temperature detected by the temperature sensor 92 is above the predetermined temperature, the control unit 90 operates the valve manifold 80 to discharge fluid through the outlet port 20. The controller 90 opens the first valve 82 and the third valve 86, and closes the second valve 84, to discharge fluid from the fluid heating device 1 to the fluid discharge device 3 through the outlet port 20. A valve (not shown) may be provided in the discharge device 3 to dispense the fluid supplied through the outlet port 20. The discharge device 3 may also include a dual motion sensor for dispensing fluid after a dual motion is detected.

During an operation in which the valve manifold 80 discharges fluid from the outlet conduit 16 to the drain port 30, the controller 90 operates the valve manifold 80 to close the first valve 82, and open the third valve 86 and the second valve 84. During an operation in which the first sensor 92 detects the temperature in the intermediate conduit 14 is less than the predetermined temperature, the controller 90 operates the valve manifold 80 to open the first valve 82 and the second valve 84, and close the third valve 86, to discharge fluid in the intermediate conduit 14 through the drain port 30. The drain port 30 may be connected to a conduit connected to the inlet port 10 or the inlet conduit 12, in order to recirculate fluid that is not yet above the predetermined temperature back into the fluid heating device 1 to be heated again and delivered to the fluid discharge device 3.

In the selected embodiments, the controller 90 may incorporate the time between operations of the activation switch 5 to either forego draining fluid from the outlet conduit 16 to the drain port 30, or allow the valve manifold 80 to drain the fluid from the outlet conduit 16 automatically without an operation of the activation switch 5. In the first case, when the controller 90 determines a period of time between operating the activation switch 5 is below a predetermined time limit, the valve manifold 80 will not drain the fluid in the outlet conduit 16 to the drain port 30. The fluid in the outlet conduit 16 would then be supplied to the discharge device 3. This would only occur in situations where the temperature of the fluid in the intermediate conduit 14 is at the predetermined temperature, and the first valve 82 and the third valve 86 of the valve manifold 80 are opened by the controller 90. This may be advantageous in situations where the switch is operated many times consecutively. Since the valve manifold 80 is operated fewer times, the overall efficiency of the fluid heating device 1 over a period of time increases with an increase in the frequency of consecutive operations. In the other case, the controller 90 may determine a pre-set time has elapsed since a previous operation of the activation switch 5. The controller 90 will operate the valve manifold 80 automatically to open the second valve 84 and the third valve 86 at the end of the pre-set time, to drain the fluid in the outlet conduit 16 to the drain port 30.

The controller 90 may include a potentiometer to control a set point, and input/outputs (I/O) for each of sending a signal to a solid state switch triode for alternating current (TRIAC) (a solid state switch that controls heat sources and turns them on and off), reading the signal from the flow sensor 60, and reading the first temperature sensor 92. The controller 90 may include an (I/O) for each of the first, second, and third valves of the valve manifold 80. The controller 90 may incorporate Pulse Width Modulation (PWM) and Proportional Integral Derivative (PID) control to manage power to the first and second heat sources (40, 50). The controller 90 may read a set point for the predetermined temperature and the temperature detected by the first temperature sensor 92 and choose a power level based a deviation between the temperatures. To achieve the set point, the PID control loop may be implemented with the PWM loop.

Regarding the activation switch 5 as illustrated in FIG. 1, in selected embodiments the activation switch 5 directly initiates the operation of the valve manifold 80 as a safety measure. This ensures that when one of the valves in the valve manifold fails, a system failure further damaging the fluid heating device 1 will not occur. Further safety measures can be provided in order to prevent the instant discharge of hot fluid when a user inadvertently operates the activation switch 5 or is unaware of the result of operation (such with a small child). Such safety mechanisms can include a time delay or a requirement that the activation switch 5 be operated, i.e., pressed, for a predetermined amount of time. The activation switch 5 may also include a dual motion sensor for initiating the operation of the fluid heating device 1. These safety mechanisms may prevent small children from activating the hot water and putting themselves in danger by touching the activation switch 5 briefly.

One advantage of the fluid heating system of FIG. 1 is the minimal standby power that is required to power the fluid heating device 1 in a standby mode of operation. Specifically, the power required is minimal (e.g. 0.3 watts) to monitor sensors, a system on/off button, and control the valves (82, 84, 86) in the valve manifold 80. Further, the valves may be solenoid valves which are arranged so that they will be in a non-powered state during periods when the fluid heating device is in standby mode. The minimal standby power provides another advantage over conventional fluid heating devices which are not used frequently. In an example where a single volume of fluid is dispensed over a period of time such as 24 hours, the fluid heating device 1 may use a minimal amount of power (e.g. 24-36 kJ), even though power is used to drain and/or partially heat and drain fluid in the fluid heating system before supplying to the fluid discharge device 3. On the other hand, conventional fluid heating devices may use an amount of power over the same period which is substantial greater (e.g. 2000 kJ).

Figure 5:
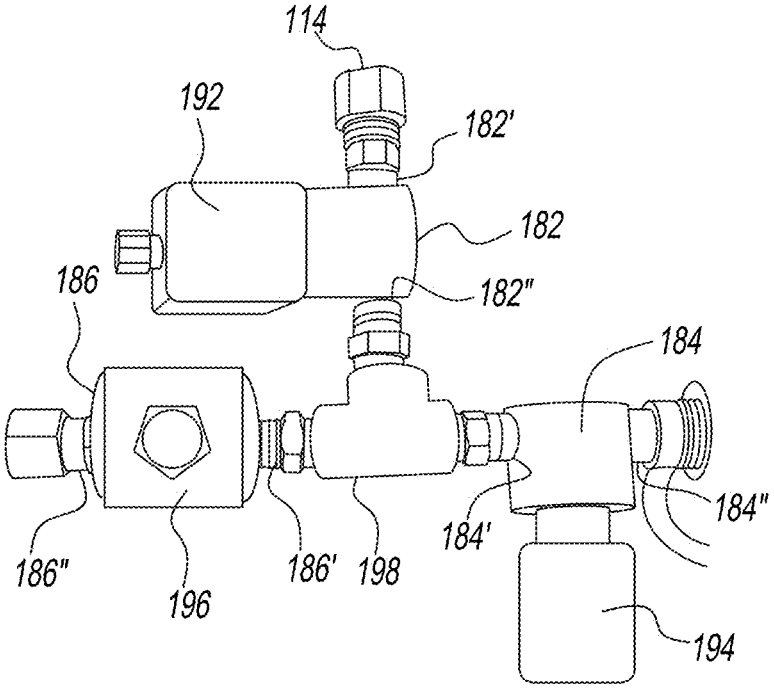
FIG. 5 illustrates a valve manifold according to one example.

FIG. 5 illustrates a valve manifold 180 in which the valves are individually piped together. As illustrated in FIG. 4, a first valve 182 includes a first port 182' connected to a fluid conduit 114, and a second port 182" that is connected to a T-fitting 198. The first valve is actuated to open and close by a first actuator 192. A second valve 184 includes a first port 184' connected to the T-fitting 198, and a second port 184" that is connected to a drain port (not shown). The second valve 184 is actuated to open and close by a second actuator 194. A third valve 186 includes a first port 186' connected to the T-fitting 198, and a second port 186" connected to an outlet port (not shown). The third valve 186 is actuated to open and close by a third actuator 196. In another selected embodiment, the first valve 182 may be installed upstream of the second valve 184 and the third valve 186.

Figure 6:
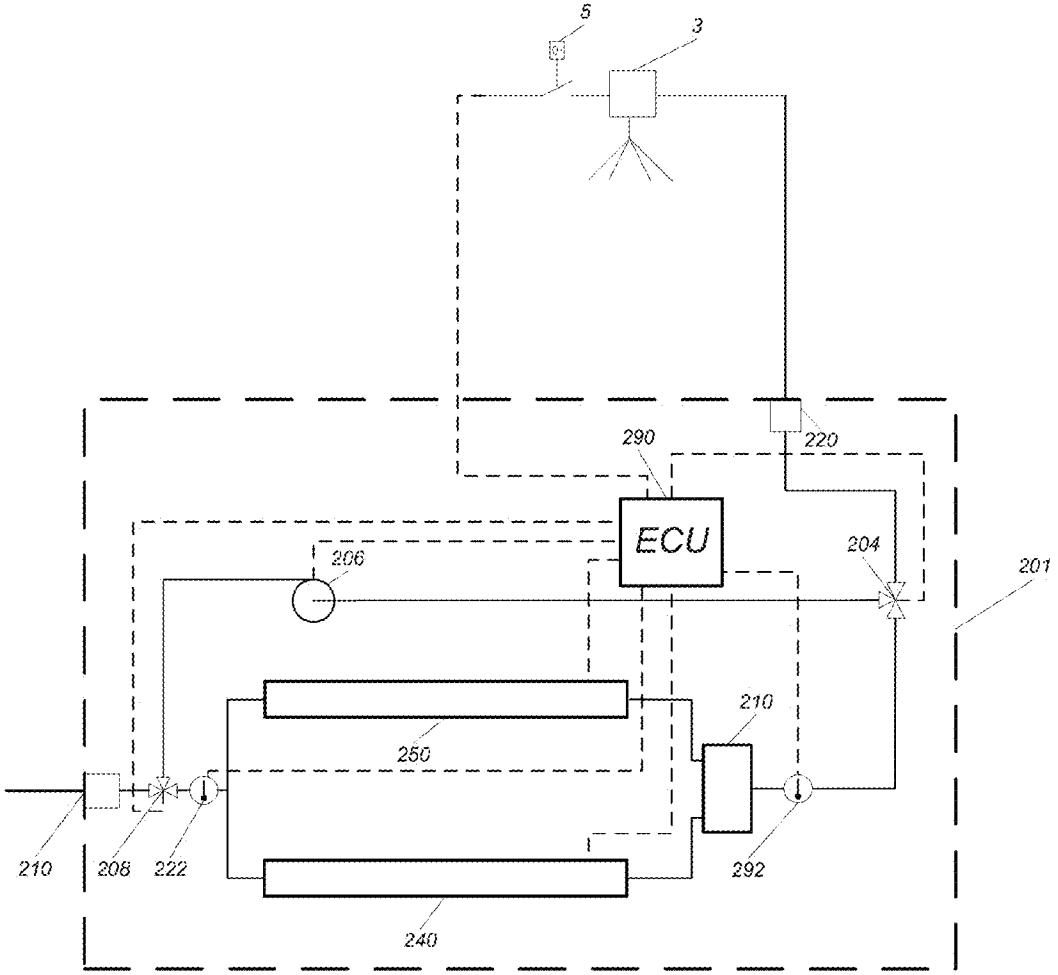
FIG. 6 schematically illustrates a fluid heating system according to one example.

FIG. 6 illustrates a fluid heating system according to another selected embodiment. In the fluid heating system illustrated in FIG. 6, a fluid heating device 201 is provided. Many of the advantages described with respect to other selected embodiments described herein, are provided by the fluid heating system of FIG. 6. The fluid heating device 201 includes an inlet port 210, an outlet port 220, a first heat source 240, a second heat source 250, a manifold 270, and a controller 290. In addition, a first control valve 204 and a pump 206 are downstream of the first temperature sensor 292, and second control valve 208 and a second temperature sensor 222 are provided upstream of the first heat source 240 and the second heat source 250. The pump 206 is connected to the second control valve 208.

Each of the first control valve 204 and the second control valve 208 is a 3-way solenoid valve. In a de-energized state, the first control valve 204 and second control valve 208 direct fluid from the inlet port 210 to the outlet port 220. In an energized state the first control valve 204 and second control valve 208 direct fluid from the manifold to the pump 206. The pump 206, supplied with power by the controller 290, circulates the fluid through a closed loop including the first heat source 240 and the second heat source 250.

During operation, when the discharge device 203 is operated, the first temperature sensor 292 sends a signal indicating the temperature of fluid in the fluid heating device 201 downstream of the manifold 270. If the temperature of the fluid in the fluid heating device 201, which may result from recent operation where the fluid discharge device 203 dispensed fluid at specific temperature, is at a desired temperature, the controller 290 will supply power to the first heat source 240 and the second heat source 250. The controller 290 will operate the first control valve 204 and the second control valve 208 to be in a de-energized state, and fluid will flow from the inlet port 210, through the heat sources, to the outlet port 220 and the discharge device 3.

In the fluid heating system of FIG. 6, when the fluid discharge device 203 is operated and the temperature detected by the first temperature sensor 292 is below a desired temperature, the first control valve 204 is energized and directs fluid to the pump 206, which is activated by the controller 290. The pump 206 conveys the fluid to the second control valve 208, which is in an energized state to provide the closed loop fluid path and direct fluid back through the first heat source 240 and the second heat source 250. The controller 290 will activate the first heat source 240 and the second heat source 250, as the fluid flows in the closed loop configuration provided by the first control valve 204 and the second control valve 208. The controller 290 will use readings from the second temperature sensor 222 to control the power supply to the first heat source 240 and the second heat source 250. When the first temperature sensor 292 detects the temperature of the fluid is at the desired temperature, the controller 290 operates at least the control valves (204, 208) to be in a de-energized state and stops a power supply to the pump 206. As a result, fluid is directed from the manifold 270 to the outlet port 220 by the first control valve 204 in the de-energized state. The controller 290 may incorporate a preset time delay between the first time the first temperature sensor 292 detects the fluid is at the desired temperature, and an end of the time delay. The controller 290 may wait for the time delay period to elapse before operating the fluid heating device 201 to deliver fluid to the fluid discharge device 203 by de-energizing the control valves (204, 208), and stopping power supply to the pump 206. The time delay may be preset or determined by the controller 290 based on the temperature readings of the first temperature sensor 292 and the second temperature sensor 222.

Figure 7:
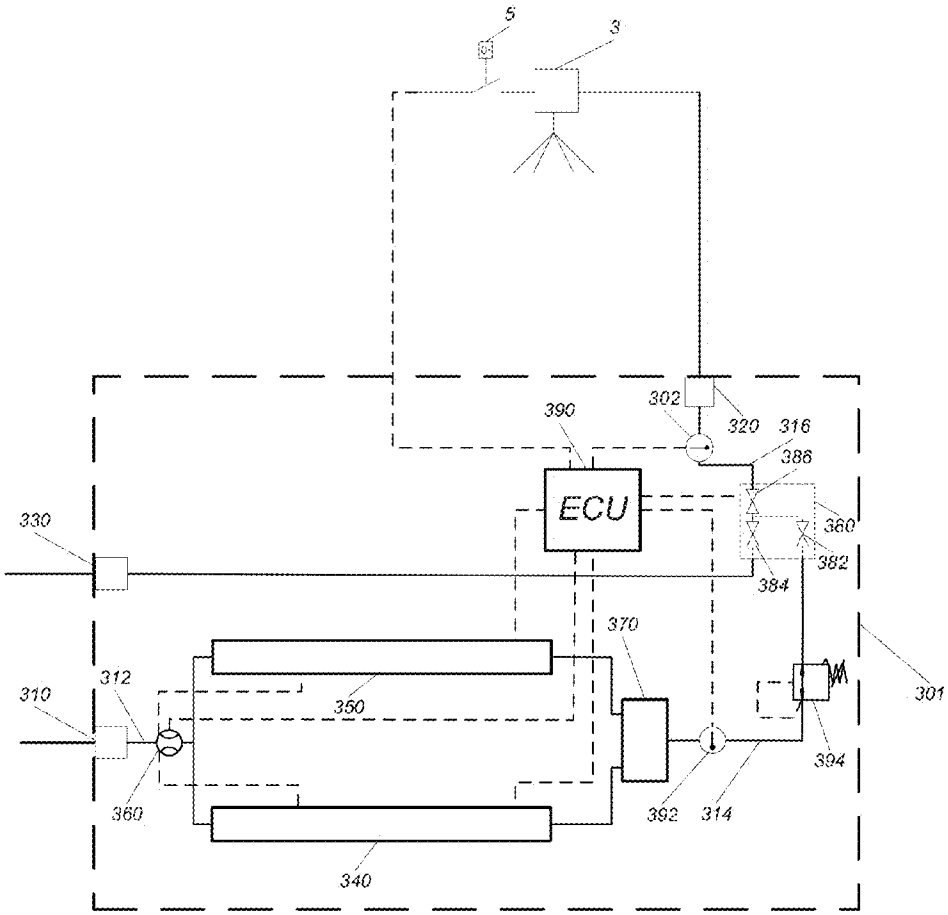
FIG. 7 schematically illustrates a fluid heating system according to one example.

FIG. 7 illustrates a fluid heating system according to another selected embodiment. In the fluid heating system illustrated in FIG. 7, a fluid heating device 301 is provided. Similar to the fluid heating device of FIG. 1, the fluid heating device 301 of FIG. 7 includes an inlet port 310, an outlet port 320, a first heat source 340, a second heat source 350, a flow sensor 360, a manifold 370, a valve manifold 380, a first temperature sensor 392, a flow regulator 394, and a controller 390. In addition, the fluid heating device 301 is provided with a second temperature sensor 302 downstream of the valve manifold 380. The second temperature sensor 302 is provided within an outlet conduit 316 in the fluid heating device 301. The second temperature sensor 302 sends a signal to the controller 390 indicating the temperature of the fluid in the outlet conduit 316.

The fluid heating device 301 can be operated in two main modes by the controller 390. In a first mode, the fluid heating device 301 operates in the same manner as the fluid heating device 101 illustrated in FIG. 1. When the activation switch 5 is operated, the controller 390 operates the valve manifold 380 to discharge fluid in outlet conduit 316 automatically to the drain port. After the fluid in the outlet conduit 316 is discharged, and the flow sensor 360 detects fluid flow at a predetermined flow rate, the first heat source 340, second heat source 350, and valve manifold 380 are operated by the controller 390 in accordance with the temperature detected by the first temperature sensor 392.

In a second mode of operation, the control unit 390 takes a reading from the second temperature sensor 302 when the activation switch 5 is operated. The controller operates the valve manifold 380 to discharge fluid from the outlet conduit 316 when the second temperature sensor 302 detects a temperature of the fluid in the outlet conduit 316 is below a predetermined temperature. In addition, when the temperature of the fluid in the outlet conduit 316 is above the predetermined temperature, or the outlet conduit 316 has been emptied through the drain port 330, and the temperature of the fluid in the fluid conduit 314 is above the predetermined temperature, the control unit 390 operates the valve manifold 380 to discharge fluid through the outlet port 320. The controller 390 opens a first valve 382 and a third valve 386, and closes a second valve 384 of the valve manifold 380 to discharge fluid from the fluid heating device 301 to the fluid discharge device 3.

When the temperature of the fluid in the outlet conduit 316 is above the predetermined temperature when the activation switch 5 is operated, the fluid heating device 301 supplies the fluid to the fluid discharge device 3 immediately. When fluid in the outlet conduit 316 is below the predetermined temperature, there is a time delay adequate to drain fluid from the outlet conduit 316 through the drain port 330 before the discharge device 3 discharges fluid. When the fluid in the heating device 301 upstream of the valve manifold 380 (in the intermediate conduit 314) is below the predetermined temperature, another time delay occurs after the activation switch 5 is operated in order for the fluid to be heated to a temperature that is equal to the predetermined temperature. It is noted that both operations using the drain port 330 may be required to be carried out before the fluid heating device 301 discharges fluid to the fluid discharge device 3.

Figure 8:
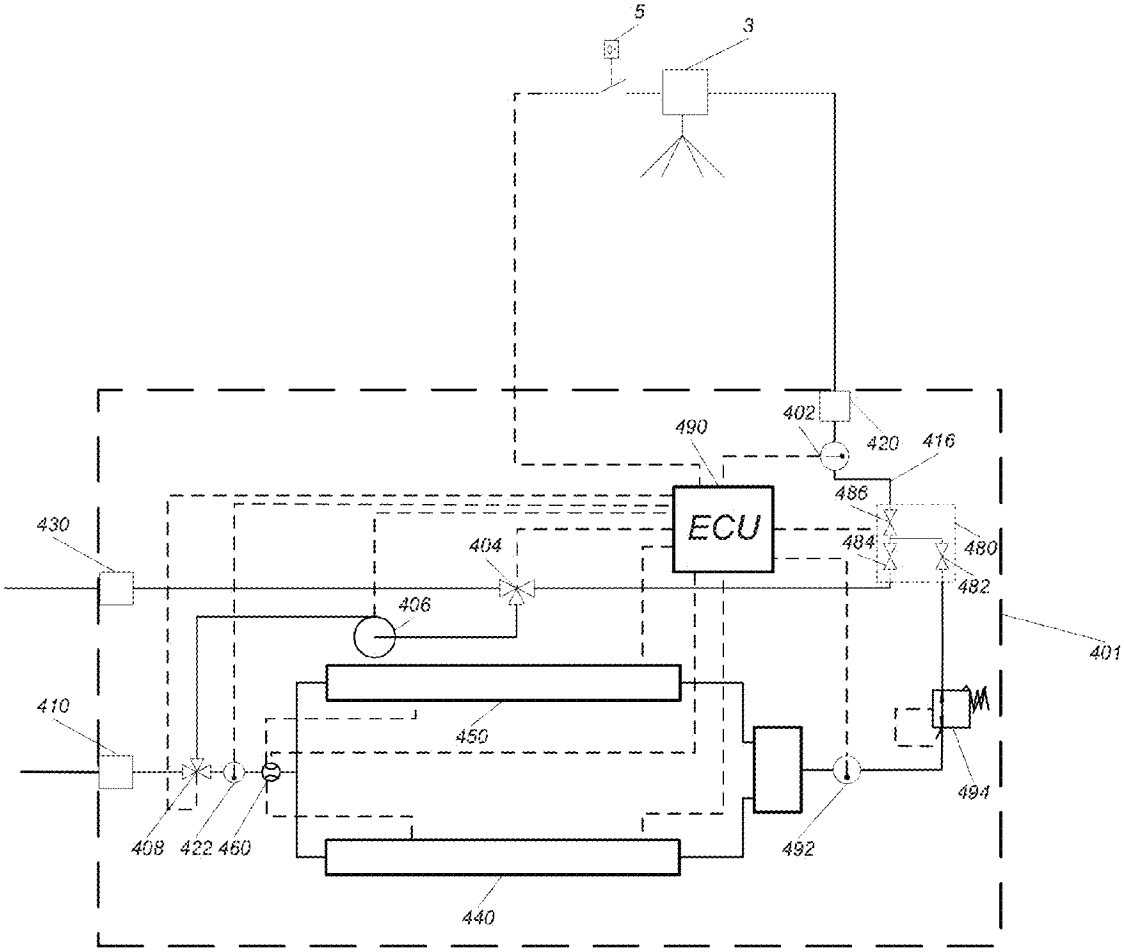
FIG. 8 schematically illustrates a fluid heating system according to one example.

FIG. 8 illustrates a fluid heating system according to another selected embodiment. In the fluid heating system illustrated in FIG. 8, a fluid heating device 401 is provided and includes an inlet port 410, an outlet port 420, a drain port 430, a first heat source 440, a second heat source 450, a flow sensor 460, a manifold 470, a valve manifold 480, a first temperature sensor 492, a flow regulator 494, and a controller 490. The valve manifold 480 includes a first valve 482 downstream of the regulator 494, a second valve 484, and a third valve 486. In addition, the fluid heating device 401 includes a second temperature sensor 402 connected to the third valve 486, and a first control valve 404 connected to the second valve 484 of the valve manifold 480. The first control valve 404 is connected to the drain port 430, and an inlet of a pump 406. An outlet of the pump 406 is connected to a second control valve 408 which is downstream of the inlet port 410, and upstream of a third temperature sensor 422. The flow sensor 460 is downstream of the third temperature sensor 422.

In a first mode of operation the first control valve 404 and the valve manifold 480 are operated to provide a fluid pathway between the valve manifold 480 and the drain port 430. The controller 490 may operate the fluid heating device 401 in one of two sub-modes which are the same as the two modes of operation described above with respect to the fluid heating device 301 of FIG. 8. In one sub-mode the controller 490 automatically operates the valve manifold 480 to direct fluid from an outlet conduit 416 to the drain port 430 when the activation switch 5 is operated. In the other sub-mode, the controller 490 takes a reading from the second temperature sensor 402 before draining the outlet conduit 416.

In a second mode of operation the valve manifold 480, first control valve 404, and second control valve 408 are operated to provide a closed loop fluid path. In this mode of operation, the valve manifold 480 and the first control valve 404 direct fluid to the pump 406, which is activated by the controller 490. The pump 406 conveys the fluid to the second control valve 408, which is operated to direct fluid back through the first heat source 440 and the second heat source 450. The controller 490 will activate the heat sources (440, 450) as fluid flows in the closed loop configuration, and take readings from the third temperature sensor 422 to control the power supply to the heat sources (440, 450). When the first temperature sensor 492 detects the temperature of the fluid is at the desired temperature, the controller 490 operates the valve manifold 470 and the control valves (404, 408) to direct fluid to the outlet port 420, and stops the power supply to the pump 406. As in the fluid heating device 201 of FIG. 6, the controller 490 may wait for a time delay period to elapse after the fluid is detected to be at a desired temperature, before operating the fluid heating device 401 to deliver fluid to the fluid discharge device 403. The time delay may be preset, or determined by the controller 490 based on the temperature readings of the first temperature sensor 492 and the third temperature sensor 408.

A number of fluid heating systems have been described. Nevertheless, it will be understood that various modifications made to the fluid heating systems described herein fall within the scope of this disclosure. For example, advantageous results may be achieved if the steps of the disclosed techniques were performed in a different sequence, if components in the disclosed systems were combined in a different manner, or if the components were replaced or supplemented by other components.

Thus, the foregoing discussion discloses and describes merely exemplary embodiments. Accordingly, this disclosure is intended to be illustrative, but not limiting of the scope of the fluid heating systems described herein, as well as other claims. The disclosure, including any readily discernible variants of the teachings herein, define, in part, the scope of the foregoing claim terminology such that no inventive subject matter is dedicated to the public.

The invention claimed is:

1. A fluid heating device comprising:
an inlet port;
an outlet port;
at least one heat source connected with the inlet port and having a first heat source outlet;
a valve manifold connected to the at least one heat source and the outlet port;
a temperature sensor connected to the valve manifold for detecting a temperature of fluid downstream of the at least one heat source; and
a controller that regulates a power supply to the at least one heat source, wherein
the controller actuates the valve manifold to discharge fluid in the heating device via the outlet port when the temperature of fluid downstream of the at least one heat source is at or above a predetermined temperature.

2. The fluid heating device of claim 1, wherein the at least one heat source heats, based on the temperature detected by the temperature sensor, the fluid until the fluid reaches the predetermined temperature.

3. The fluid heating device of claim 1, further comprising:
a flow sensor detecting a flow rate of fluid upstream of the at least one heat source, wherein
the at least one heat source is actuated to heat fluid by a flow switch of the flow sensor when the flow rate of fluid upstream of the at least one heat source is at or above a predetermined flow rate.

4. The fluid heating device of claim 1, wherein
the at least one heat source includes a first heat source and a second heat source,
the first heat source includes the first heat source outlet,
the second heat source includes a second heat source outlet, and
the first heat source outlet and the second heat source outlet are connected to a first manifold and the first manifold is connected to the valve manifold.

5. The fluid heating device of claim 1, further comprising:
a first manifold connected to the first heat source outlet;
a first conduit that connects the inlet port to the at least one heat source;
a second conduit that connects the first manifold to the valve manifold; and
a third conduit that connects the valve manifold to the outlet port.

6. The fluid heating device of claim 5, further comprising:
a flow control device provided in the second conduit downstream of the first manifold, wherein
the controller actuates the at least one heat source to heat the fluid in the fluid heating device in response to a flow of fluid upstream of the at least one heat source being equal to or greater than the predetermined flow rate, and
the flow control device controls a flow of fluid downstream of the first manifold to be equal to a predetermined flow rate.

7. The fluid heating device of claim 1, wherein the valve manifold includes:
a first valve connected to a first manifold; and
a second valve connected to the outlet port.

8. The fluid device of claim 7, wherein the first and second valves are solenoid valves.

9. The fluid heating device of claim 7, wherein
the first valve includes a first port connected to the first manifold, and
the second valve includes a second port connected to the outlet port.

10. A fluid heating system comprising:
a fluid heating device including:
an inlet port,
an outlet port,
at least one heat source connected with the inlet port and having a first heat source outlet,
a valve manifold connected to the at least one heat source and the outlet port,
a temperature sensor connected to the valve manifold for detecting a temperature of fluid downstream of the at least one heat source,
a fluid discharge device connected to the outlet port;
a switch connected to the fluid discharge device, wherein when the switch is operated and a flow rate of fluid in the fluid heating device is at or above a predetermined flow rate, the at least one heat source is actuated; and a controller that regulates a power supply to the at least one heat source, wherein the controller actuates the valve manifold to discharge fluid in the heating device via the outlet port when the temperature of fluid downstream of the at least one heat source is at or above a predetermined temperature.

11. The fluid heating device of claim 10, wherein the valve manifold of the fluid heating device includes:

a first valve connected to a first manifold; and a second valve connected to the outlet port.

12. The fluid device of claim 11, wherein the controller opens the first valve and the second valve when the switch is operated and the temperature sensor indicates the temperature of fluid downstream of the at least one heat source is above the predetermined temperature.

13. A method of heating fluid with a fluid heating device including an inlet port, an outlet port, at least one heat source connected with the inlet port and having a first heat source outlet, a valve manifold connected to the at least one heat source, and the outlet port, and a temperature sensor connected to the valve manifold, a controller that regulates a power supply to the at least one heat source, the method comprising:

detecting a temperature of fluid downstream of the at least one heat source with the temperature sensor;

actuating the valve manifold with the controller to discharge fluid in the heating device via the outlet port when the temperature of fluid downstream of the at least one heat source is at or above a predetermined temperature.

14. The method of claim 13, further comprising:

detecting a flow rate of fluid upstream of the at least one heat source when an activation switch is operated;

determining the flow rate of fluid upstream of the at least one heat source is equal to or greater than a predetermined flow rate, and operating the at least one heat source to heat fluid in the at least one heat source in response to the flow rate of fluid upstream of the at least one heat source being equal to or greater than the predetermined flow rate.

15. The method of claim 14, further comprising:

regulating a flow of fluid downstream of the at least one heat source outlet to be equal to the predetermined flow rate.

* * * * *